US011168953B2

(12) United States Patent
Philbin et al.

(10) Patent No.: US 11,168,953 B2
(45) Date of Patent: Nov. 9, 2021

(54) AMMUNITION MAGAZINE

(71) Applicant: Perfetto Performance Inc., Glenview, IL (US)

(72) Inventors: Kevin Philbin, Glenview, IL (US); Scott Richard Gherardini, Jr., Hoffman Estates, IL (US)

(73) Assignee: Perfetto Performance Inc., Glenview, IL (US)

( * ) Notice: Subject to any disclaimer, the term of this patent is extended or adjusted under 35 U.S.C. 154(b) by 0 days.

(21) Appl. No.: 17/076,341

(22) Filed: Oct. 21, 2020

(65) Prior Publication Data

US 2021/0116195 A1 Apr. 22, 2021

Related U.S. Application Data

(60) Provisional application No. 62/924,165, filed on Oct. 21, 2019.

(51) Int. Cl.
*F41A 9/62* (2006.01)
*F41A 9/70* (2006.01)

(52) U.S. Cl.
CPC ..... *F41A 9/70* (2013.01)

(58) Field of Classification Search
CPC ..... F41A 9/70; F41A 9/65; F41A 9/69; F41A 9/62; F41A 9/83
USPC ..... 42/50
See application file for complete search history.

(56) References Cited

U.S. PATENT DOCUMENTS

| | | | | |
|---|---|---|---|---|
| 2,908,987 | A * | 10/1959 | Allyn | F41A 9/65 42/18 |
| 3,039,366 | A * | 6/1962 | Imthurn | F41A 17/38 89/138 |
| 4,926,742 | A * | 5/1990 | Ma | F41A 9/75 42/49.01 |
| 2011/0005113 | A1* | 1/2011 | Fitzpatrick | F41A 9/65 42/1.02 |
| 2021/0010769 | A1* | 1/2021 | Czarnecki | F41A 9/62 |
| 2021/0215446 | A1* | 7/2021 | Czarnecki | G05B 15/02 |
| 2021/0254916 | A1* | 8/2021 | Czarnecki | F41A 9/62 |

* cited by examiner

*Primary Examiner* — Michael D David
(74) *Attorney, Agent, or Firm* — Incubate IP; Randy R. Micheletti

(57) ABSTRACT

The present disclosure provides ammunition magazines for bottom-loading a 5.7×28 mm ammunition round or a 4.6×30 mm ammunition round into a standard AR-15 or M16 upper receiver.

3 Claims, 5 Drawing Sheets

AMMUNITION MAGAZINE

CROSS REFERENCE TO RELATED APPLICATIONS

This application claims the benefit of Provisional Patent Application Ser. No. 62/924,165 filed Oct. 21, 2019, the entirety of which is incorporated by reference.

FEDERALLY SPONSORED RESEARCH

None.

SEQUENCE LISTING OR PROGRAM

None.

STATEMENT REGARDING PRIOR DISCLOSURES BY THE INVENTOR

None.

BACKGROUND

A. Field of Disclosure

The present disclosure relates to mechanical devices that serve to receive and load rounds of ammunition into a firearm, and more particularly, loading calibers of ammunition into the AR-15 and M16 firearm platforms. In application the mechanical device allows two common varieties of ammunition round platforms, specifically FN 5.7×28 mm rounds and 4.6×30 rounds, to be bottom loaded into an upper receiver of a firearm, such as an AR-15 or M16 rifle, prior to use.

B. Description of Related Art

The AR-15 and M16 firearm platforms are versatile, enabling reliable firing of many calibers of ammunition. The 5.7×28 mm round (hereinafter "Five-Seven round"), for example the FN 5.7×28 mm round by FN Herstal was designed for the FN Five-Seven handgun and the FN P90 sub-compact submachine gun.

While others have developed upper receivers for utilizing Five-Seven rounds with the AR-15 or lower receivers for use with the M16, such attempts require either top-loading or horizontal-loading magazine arrangements, which are bulky and inconvenient on both the AR-15 and M16 platforms. Similarly, the HK 4.6×30 mm round (hereinafter "4.6×30 round") by Heckler & Koch was designed for submachine gun personal defense weapons (i.e., the HK MP7), which typically rely on a short-stroke gas piston ejection system, rather than the blowback ejection system incorporated into the AR-15 and M16 upper receivers and bolt systems. The inventors are not aware of any conversion systems currently available for using the 4.6×30 round in an AR-15 or M16 bottom-loading configuration.

Both the Five-Seven and 4.6×30 rounds are preferred by international military organizations, such as NATO, as they are lighter and more economical than most caliber rounds for AR-15 and M16 firearms. A need persists for convenient means of bottom-loading the Five-Seven and 4.6×30 rounds into an AR-15 or M16 upper receiver.

BRIEF SUMMARY OF THE DISCLOSURE

The present disclosure provides ammunition magazines for bottom-loading a 5.7×28 mm ammunition round or a 4.6×30 mm ammunition round into a standard AR-15 or M16 upper receiver. The ability to bottom-load a standard AR-15 or M16 provides the user with many advantages. One advantage being the user will not need to remove the magazine from the assembled firearm in order to load caliber rounds. This improves usability and eliminates bulk.

In some embodiments, the present disclosure provides an ammunition magazine configured to bottom-feed a plurality of ammunition rounds into an upper receiver of a firearm, such as a standard AR-15 or M16. The ammunition magazine generally comprises a magazine housing, a spring, a floor plate retained at the bottom end of the spring, a floor plate disposed at the bottom end of the magazine housing and reversibly mated with the floor plate retainer, and a magazine follower. In one embodiment the magazine follower exists within the interior chamber of the magazine and moves slidingly therethrough. One embodiment additionally contains a spring within the magazine housing, the spring having a top end attached to a magazine follower and bottom end attached to floor plate retainer. The floor plate is generally mated, for example reversibly mated, with a floor plate receiver disposed at bottom end of magazine, whereby force being exerted by the spring facilitates movement of the magazine follower through the interior chamber of the magazine in response to force exerted by the spring.

In one embodiment the interior of the magazine housing includes two opposing lateral tines, a tail recess, a catch, and a floor plate receiver. The lateral tines are configured to slidingly mate with lateral recesses of the magazine follower to facilitate movement of the follower within the interior chamber of the magazine. In one embodiment the opposing lateral tines of the magazine housing have the additional function of making contact with the ammunition, preferably at the shoulder region of the ammunition, to aid in alignment and prevent improper contact of the ammunition and interior walls of the magazine chamber. In one embodiment the magazine follower additionally includes a cartridge-shaped protrusion on a top surface, a concave surface on the top surface and disposed adjacent to the cartridge-shaped protrusion, an opening disposed vertically through the magazine follower and through the top surface, a front leg including a front recess disposed vertically along the front leg, a rear leg disposed generally opposite the front leg, and a tail fin disposed adjacent the rear leg and configured to slidably mate with the tail recess of the magazine housing. Additionally, the embodiment may include a floor plate disposed fixedly to the bottom end of the magazine housing and reversibly mated with a floor plate retainer of the magazine housing. This allows the user to remove the floorplate exposing the magazine follower from the distal end of the magazine for efficient bottom-loading.

In other embodiments, the present disclosure provides a magazine follower comprising: a cartridge-shaped protrusion on a top surface, a concave surface on the top surface and disposed adjacent to the cartridge-shaped protrusion, an opening disposed vertically through the magazine follower and through the top surface, a front leg including a front recess disposed vertically along the front leg, a rear leg disposed generally opposite the front leg, a pair of lateral recesses configured to slidably mate with the two opposing lateral tines, and a tail fin disposed adjacent the rear leg and configured to slidably mate with the tail recess, wherein the concave surface is sized and shaped to receive at least a portion of a 5.7×28 mm ammunition round or a 4.6×30 mm ammunition round.

For purposes of summarizing the present disclosure, certain aspects, improvements, notable features, and distinct advantages over the prior art are described herein. It is to be understood that not every feature and advantage is meant to be achieved in any single embodiment of the current disclosure. It is to be acknowledged that one with skill in the art will recognize the advantages embodied by the present disclosure and achieve some advantages without necessarily achieving other specific embodiments or aspects as described herein. The embodiments described herein are not limited in their scope and should be considered in conjunction with the accompanying drawings which provide non-exclusive illustration of potential embodiments.

DETAILED DESCRIPTION OF THE DISCLOSURE

In general, the present disclosure provides ammunition magazines for bottom-loading a Five-Seven ammunition round or a 4.6×30 mm ammunition round into a standard AR-15 or M16 upper receiver. Ammunition magazines consistent with the present disclosure generally comprise a magazine housing 10, a spring (not shown) within the magazine housing 10, a follower 20/30 disposed on a top end of the spring, a floor plate retainer 40 disposed on the bottom end of the spring opposite the follower 20/30, and a floor plate 50 disposed on the bottom end of the magazine housing.

Figure 1A:
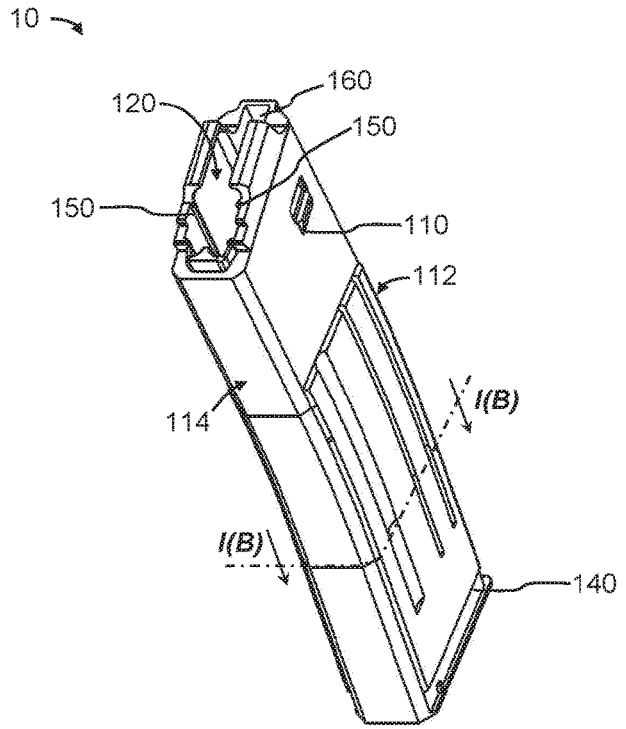
FIG. 1A shows a perspective view of an ammunition magazine housing consistent with at least one embodiment of the present disclosure.
Figure 1B:
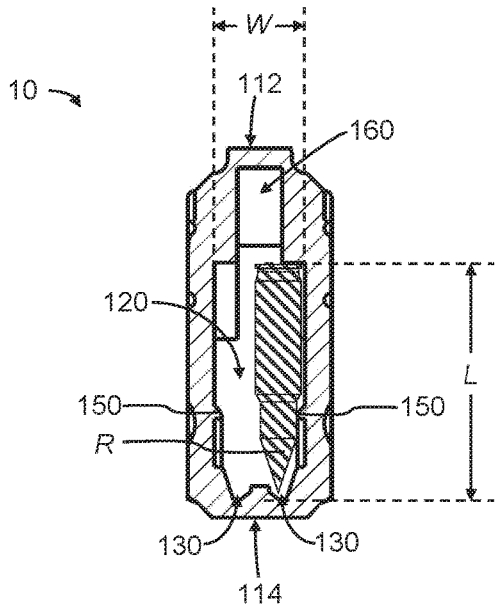
FIG. 1B shows a cross-sectional view of the ammunition magazine housing of FIG. 1A including a housed round of ammunition R.

Referring now specifically to FIGS. 1A-1B, the magazine housing 10 includes a catch 110, a pair of opposing lateral tines 150 within the cavity 120, a tail recess 160 within the cavity 120, and a floor plate receiver 140 on the bottom end of the magazine housing 10. The cavity 120 is sized to accommodate two stacked, overlapping columns of ammunition rounds. For example, a magazine housing 10 for bottom-feeding Five-Seven rounds R may have a cavity 120 including a width W of about 15.8 mm, and a length L of about 41.3 mm. Similarly, a magazine housing 10 for bottom-feeding 4.6×30 mm rounds R may have a cavity 120 including a width W of about 15.8 mm, and a length L of about 39.7 mm.

The magazine housing 10 includes lateral tines 150 on opposite inside faces of the magazine housing 10. The lateral tines 150 extend into the cavity 120 and contact the shoulder of the ammunition round R to help stabilize the orientation of the round R within the magazine housing 10. The lateral tine 150 extends into the cavity a distance that is approximately equal to half the difference between the width of the round casing at its widest point and the width of the shoulder of the round casing. For example, the lateral tine 150 extends approximately 1.2-1.3 mm into the cavity 120.

The cavity 120 includes two bullet tip slots 130 disposed near the anterior end 114 of the magazine housing 10 and configured to enable the bullet tips of the ammunition rounds R to slide vertically through the magazine housing 10 without contacting the magazine housing 10.

The magazine housing 10 further includes a tail recess 160 extending vertically through the magazine housing 10. The tail recess 160 is disposed near the posterior end 112 of the magazine housing 10, and ensures that the follower 20/30 (described in more detail below) travels vertically through the magazine housing 10 smoothly.

The magazine housing 10 further includes a floor plate receiver 140 at the bottom of the magazine housing 10. The floor plate receiver 140 enables the floor plate 50 (described in greater detail below) to slidably mate to the bottom of the magazine housing 10.

The magazine housing 10 further includes a catch 110 for selectably mating with the magazine catch of a firearm's lower receiver (not shown).

Figure 2:
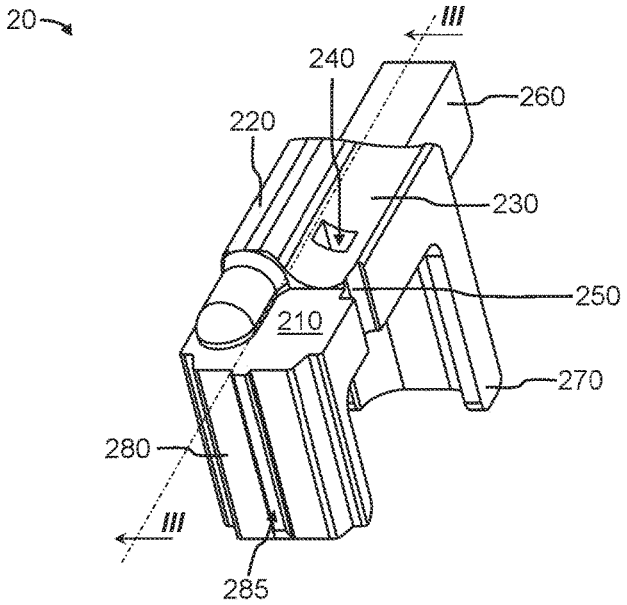
FIG. 2 shows a perspective view of a magazine follower consistent with at least one embodiment of the present disclosure.
Figure 3:
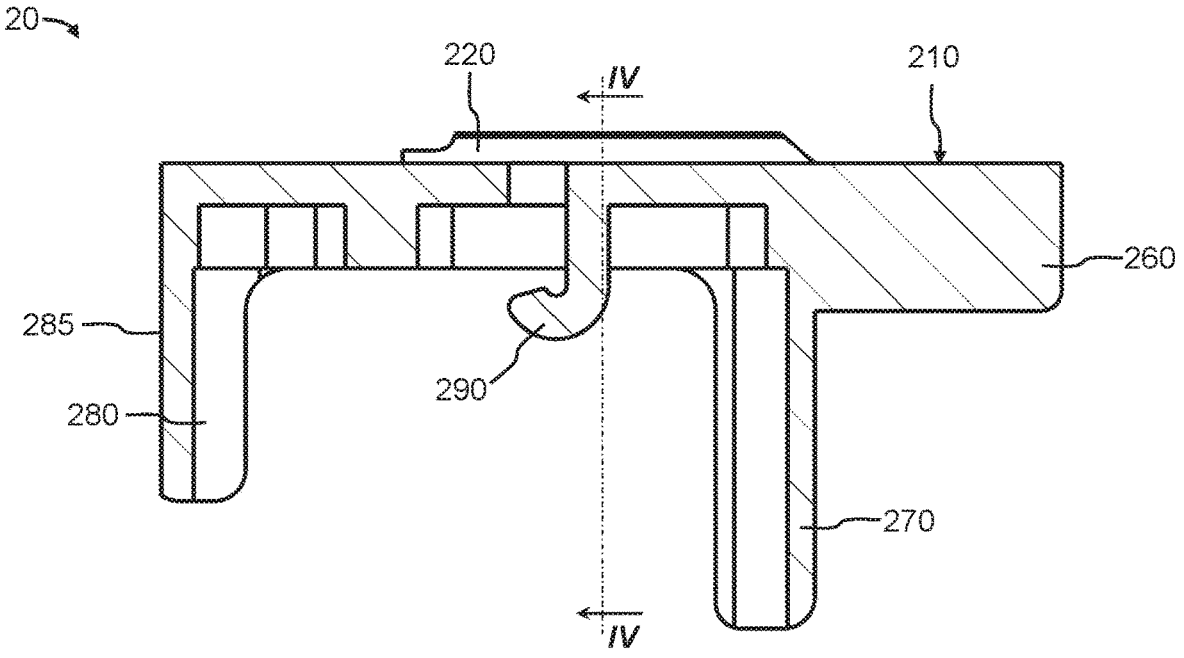
FIG. 3 shows a longitudinal cross-sectional view of the magazine follower of FIG. 2.
Figure 4:
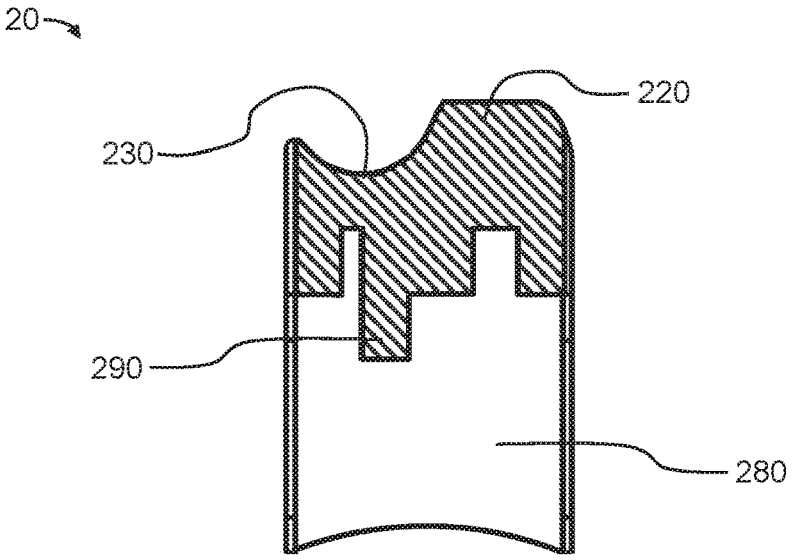
FIG. 4 shows a lateral cross-sectional view of the magazine follower of FIG. 2.

Referring now to FIGS. 2-4, a follower 20 for use with Five-Seven rounds includes a top surface 210, a cartridge-shaped protrusion 220, a concave surface 230, a cavity 240, a pair of opposing lateral recesses 250, a tail fin 260, a rear leg 270, a front leg 280, and a spring hook 290.

The top surface 210 contacts a first layer of ammunition rounds R within the cavity 120, and includes a cartridge-shaped protrusion 220 and a concave surface 230. The first loaded ammunition round R is inserted laterally into the concave surface 230, and is held to one side of the cavity 120 due to the cartridge-shaped protrusion 220 contacting the ammunition round casing. The second loaded ammunition round R contacts both the first loaded ammunition round R and the cartridge-shaped protrusion 220, and is held to the other side of the cavity.

The pair of lateral recesses 250 slidably mate with the pair of opposing lateral tines 150.

The tail fin 260 slidably mates with the tail recess 160. The tail fin 260 generally has a width of about 25% to about 50% of the overall width of the magazine housing 10, for example about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, or about 50% of the overall width of the magazine housing 10.

The rear leg 270 and the front leg 280 are disposed on opposite longitudinal sides of the spring and stabilize the follower 20 on the top end of the spring. The lateral sides of the rear leg 270 contact the inner surface of the magazine housing 10.

The lateral sides of the front leg 280 and the front ridge 285 contact the inner surface of the magazine housing 10;

the front ridge 285 in particular contacts the region of the inner surface of the magazine housing 10 between the bullet tip slots 130.

The opening 240 extends vertically through the follower 20 and improves the molding process for forming the follower 20 from resin-based materials.

As shown best in FIG. 3, the follower 20 includes a spring hook 290 between the front leg 280 and the rear leg 290. The spring hook 290 reversibly mates with the top end of the spring (not shown).

Operating together, the pair of lateral recesses 250 and the lateral tines 150, the tail fin 260 and the tail recess 160, and the front ridge 285 and the bullet tip slots 130 ensure that the follower 20 travels smoothly within the cavity 120 and orthogonal to the force exerted onto the follower 20 by the spring.

Figure 5:
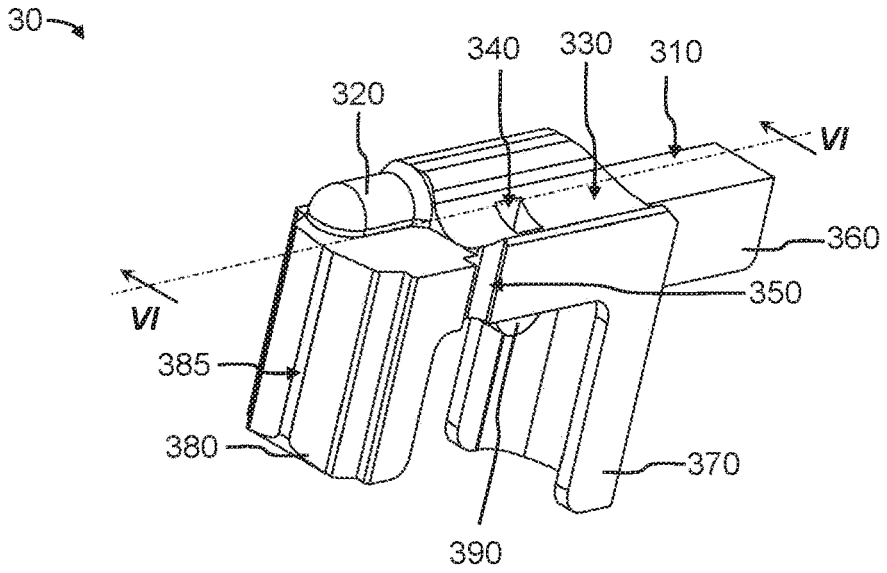
FIG. 5 shows a perspective view of a magazine follower consistent with at least one embodiment of the present disclosure.
Figure 6:
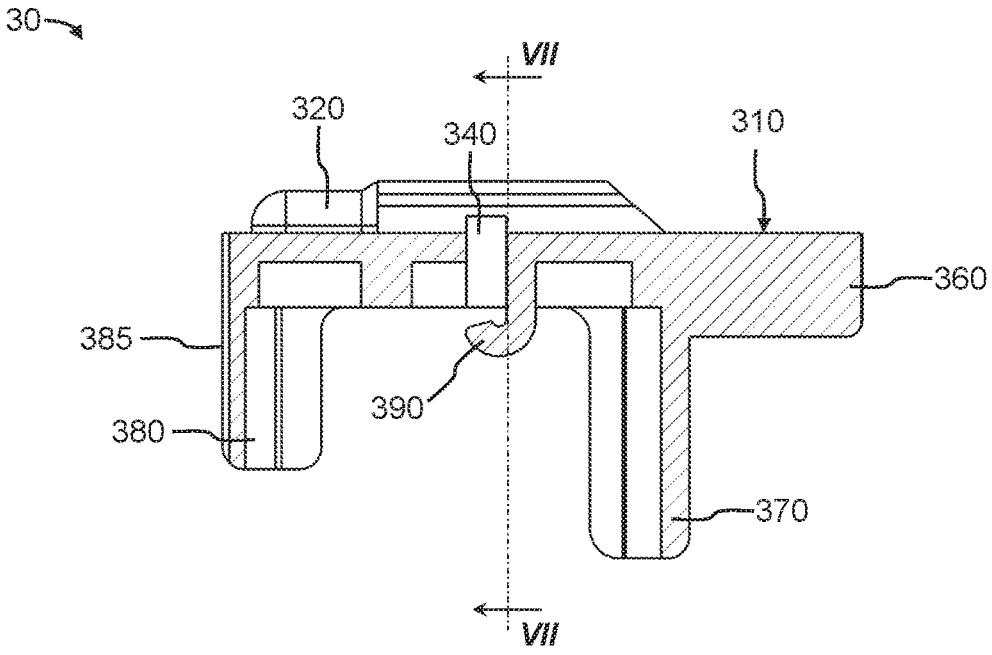
FIG. 6 shows a longitudinal cross-sectional view of the magazine follower of FIG. 5.
Figure 7:
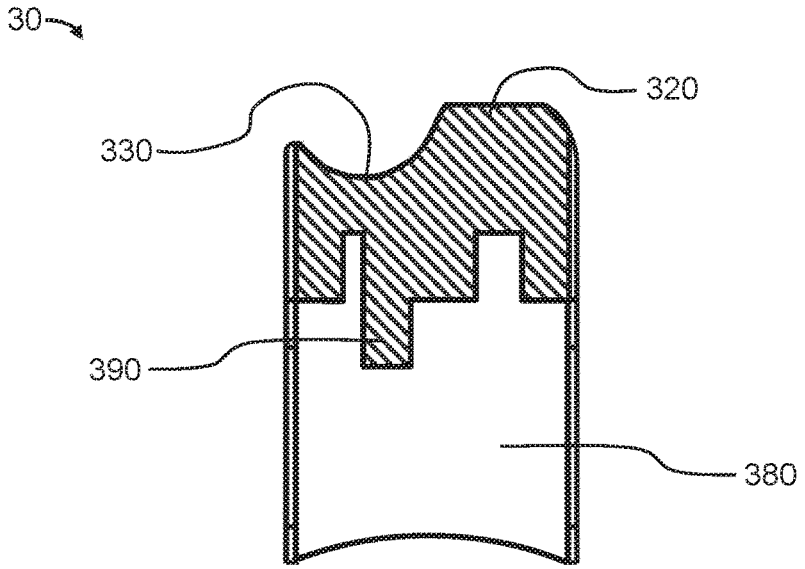
FIG. 7 shows a lateral cross-sectional view of the magazine follower of FIG. 5.

Referring now to FIGS. 5-7, a follower 30 for use with 4.6×30 mm rounds includes a top surface 310, a cartridge-shaped protrusion 320, a concave surface 330, a cavity 340, a pair of opposing lateral recesses 350, a tail fin 360, a rear leg 370, a front leg 380, and a spring hook 390.

The top surface 310 contacts a first layer of ammunition rounds R within the cavity 120, and includes a cartridge-shaped protrusion 320 and a concave surface 330. The first loaded ammunition round R is inserted laterally into the concave surface 330, and is held to one side of the cavity 120 due to the cartridge-shaped protrusion 310 contacting the ammunition round casing. The second loaded ammunition round R contacts both the first loaded ammunition round R and the cartridge-shaped protrusion 330, and is held to the other side of the cavity.

The pair of lateral recesses 350 slidably mate with the pair of opposing lateral tines 150.

The tail fin 360 slidably mates with the tail recess 160. The tail fin 360 generally has a width of about 25% to about 50% of the overall width of the magazine housing 10, for example about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, or about 50% of the overall width of the magazine housing 10.

The rear leg 370 and the front leg 380 are disposed on opposite longitudinal sides of the spring and stabilize the follower 30 on the top end of the spring. The lateral sides of the rear leg 370 contact the inner surface of the magazine housing 10. The lateral sides of the front leg 380 and the front ridge 385 contact the inner surface of the magazine housing 10; the front ridge 385 in particular contacts the region of the inner surface of the magazine housing 10 between the bullet tip slots 130.

The opening 340 extends vertically through the follower 20 and improves the molding process for forming the follower 20 from resin-based materials.

As shown best in FIG. 6, the follower 20 includes a spring hook 390 between the front leg 380 and the rear leg 370. The spring hook 390 reversibly mates with the top end of the spring (not shown).

Operating together, the pair of lateral recesses 350 and the lateral tines 150, the tail fin 360 and the tail recess 160, and the front ridge 385 and the bullet tip slots 130 ensure that the follower 30 travels smoothly within the cavity 120 and orthogonal to the force exerted onto the follower 30 by the spring.

Figure 8:
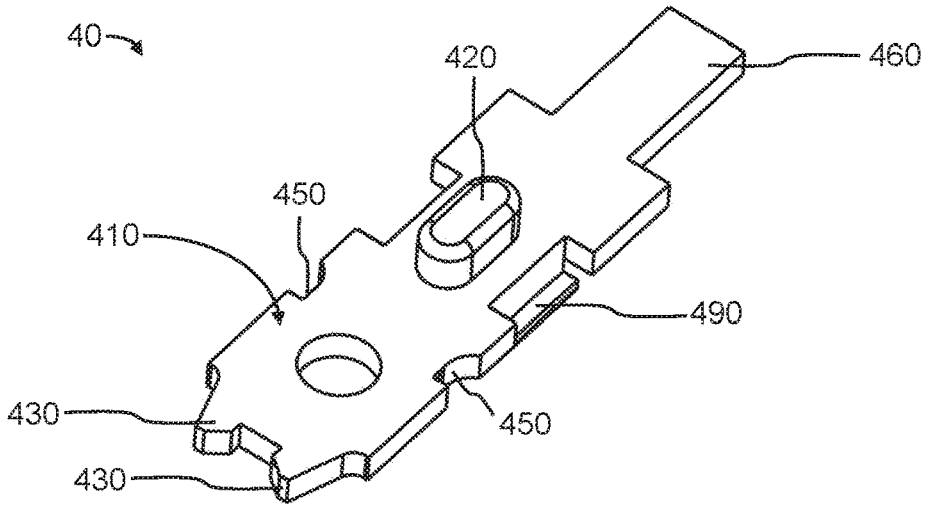
FIG. 8 shows a perspective view of a floor plate retainer (also referred to as a spring floor plate) consistent with at least one embodiment of the present disclosure.

Referring now to FIG. 8, the floor plate retainer 40 includes a pair of spring catches 490 configured to reversibly mate with the spring (not shown). The bottom surface 410 includes a floor plate protrusion 420 that selectably mates with the floor plate 50. The tail fin 460 engages with the tail recess 160, while the pair of tip protrusions 430 engage with the bullet tip slots 130 and the pair of lateral recesses 450 engage with the lateral tines 150 such that the floor plate retainer 40 fits snugly within the cavity 120.

Figure 9:
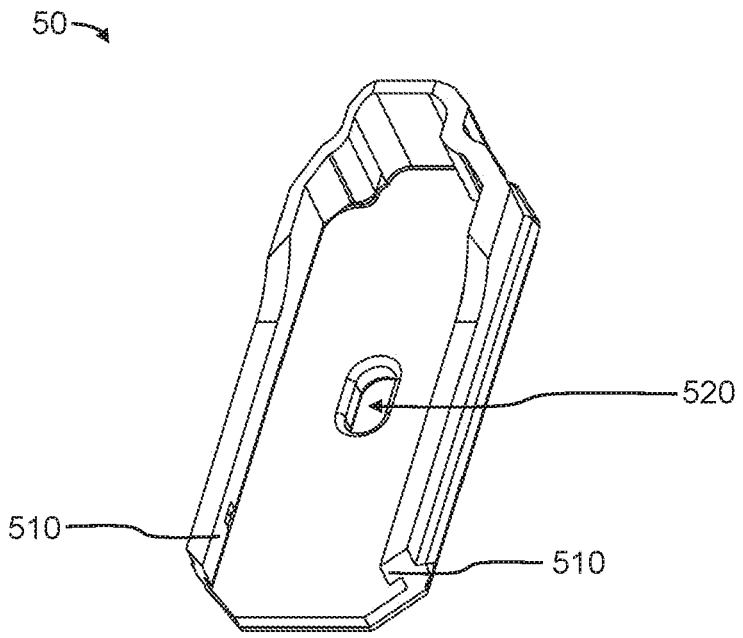
FIG. 9 shows a perspective view of a magazine floor plate consistent with at least one embodiment of the present disclosure.

As shown in FIG. 9, the floor plate 50 includes a pair of opposing magazine housing rails 510 for slidably mating with the floor plate receivers 140, and a floor plate retainer notch 520 for selectably mating with the floor plate protrusion 420.

To remove the spring and follower 20/30 from the cavity 120, the floor plate protrusion 420 is advanced into the cavity 120 and the floor plate 50 is then slid along the floor plate receivers 140 to disengage the floor plate 50 from the magazine housing 10. The force of the spring will tend to push the floor plate retainer 40 out of the cavity 120. By pulling on the spring, the follower 20/30 may then be removed from the cavity 120.

To assemble the magazine, a follower 20/30 is attached to the top end of the spring, and the follower 20/30 and attached spring are then advanced into the cavity 120, top surface 210/310 first. The floor plate retainer 40 is then advanced into the cavity 120 (e.g., by pressing on the floor plate retainer 40 against the force of the spring), and the floor plate 50 may then be slid along the floor plate receivers 140. When the floor plate 50 is fully engaged with the bottom end of the magazine housing 10, the floor plate protrusion 420 of the floor plate retainer 40 will engage with the floor plate retainer notch 520 due to the force of the spring.

In some embodiments, the present disclosure provides an ammunition magazine configured to bottom-feed a plurality of ammunition rounds into an upper receiver of a firearm, the ammunition magazine comprising: a magazine housing 10 including two opposing lateral tines 150, a tail recess 160, a catch 110, and a floor plate receiver 140; a spring within the magazine housing 10; a floor plate retainer 40 disposed at a bottom end of the spring; a floor plate 50 disposed at a bottom end of the magazine housing 10 and reversibly mated with the floor plate retainer 40; and a magazine follower 20/30 disposed at a top end of the spring, the magazine follower 20/30 including: a cartridge-shaped protrusion 220/320 on a top surface 210/310, a concave surface 230/330 on the top surface 210/310 and disposed adjacent to the cartridge-shaped protrusion 220/320, an opening disposed vertically through the magazine follower 20/30 and through the top surface 210/230, a front leg 280/380 including a front recess 285/385 disposed vertically along the front leg 280/380, a rear leg 270/370 disposed generally opposite the front leg 280/380, a pair of lateral recesses 250/350 configured to slidably mate with the two opposing lateral tines 150, and a tail fin 260/360 disposed adjacent the rear leg 270/370 and configured to slidably mate with the tail recess 160. In some embodiments, the ammunition round R is a Five-Seven round (i.e., a 5.7×28 mm round). In some embodiments, the ammunition round R is a 4.6×30 mm round.

In other embodiments, the present disclosure provides a magazine follower 20/30 comprising: a cartridge-shaped protrusion 220/320 on a top surface 210/310, a concave surface 230/330 on the top surface 210/310 and disposed adjacent to the cartridge-shaped protrusion 220/320, an opening disposed vertically through the magazine follower 20/30 and through the top surface 210/310, a front leg 280/380 including a front recess 285/385 disposed vertically along the front leg 280/380, a rear leg 270/370 disposed generally opposite the front leg 280/380, a pair of lateral recesses 250/350 configured to slidably mate with the two opposing lateral tines 150, and a tail fin 260/360 disposed adjacent the rear leg 270/370 and configured to slidably mate with the tail recess 160, wherein the concave surface 230/330 is sized and shaped to receive at least a portion of a Five-Seven round (i.e., a 5.7×28 mm ammunition round) R or a 4.6×30 mm ammunition round R.

Use of the ammunition magazines 20/30 disclosed herein, along with an appropriately configured bolt and bolt carrier assembly, enable firing of Five-Seven and 4.6×30 mm ammunition rounds from an AR-15 or M16 firearm. The Five-Seven and 4.6×30 mm ammunition rounds are bottom-fed and spent ammunition casings may be conveniently side-ejected through the ejection port of a standard AR-15 or M16 upper receiver, unlike systems common in the state-of-the-art for firing Five-Seven or 4.6×30 mm ammunition rounds from similar firearms.

What is claimed is:

1. An ammunition magazine configured to bottom-feed a plurality of ammunition rounds into an upper receiver of a firearm, the ammunition magazine comprising:

a magazine housing including two opposing lateral tines, a tail recess, a catch, and a floor plate receiver;

a spring within the magazine housing;

a floor plate retainer disposed at a bottom end of the spring;

a floor plate disposed at a bottom end of the magazine housing and reversibly mated with the floor plate retainer; and a magazine follower disposed at a top end of the spring, the magazine follower including:

a cartridge-shaped protrusion on a top surface, a concave surface on the top surface and disposed adjacent to the cartridge-shaped protrusion, an opening disposed vertically through the magazine follower and through the top surface, a front leg including a front recess disposed vertically along the front leg, a rear leg disposed generally opposite the front leg, a pair of lateral recesses configured to slidably mate with the two opposing lateral tines, and a tail fin disposed adjacent the rear leg and configured to slidably mate with the tail recess.

2. The ammunition magazine of claim 1, wherein the ammunition rounds are 5.7×28 mm rounds.

3. The ammunition magazine of claim 1, wherein the ammunition rounds are 4.6×30 mm rounds.

* * * * *